US011359872B2

(12) United States Patent
Hooijkamp et al.

(10) Patent No.: US 11,359,872 B2
(45) Date of Patent: Jun. 14, 2022

(54) HEAT EXCHANGER

(71) Applicant: HIETA TECHNOLOGIES LIMITED, Bristol (GB)

(72) Inventors: Evert Hooijkamp, Bristol (GB); Niall Edward Hatfield, Bristol (GB); Ahmed Hussein, Bristol (GB); Stephen Mellor, Bristol (GB)

(73) Assignee: HIETA TECHNOLOGIES LIMITED, Bristol (GB)

( * ) Notice: Subject to any disclaimer, the term of this patent is extended or adjusted under 35 U.S.C. 154(b) by 73 days.

(21) Appl. No.: 16/631,631

(22) PCT Filed: May 18, 2018

(86) PCT No.: PCT/GB2018/051351
§ 371 (c)(1),
(2) Date: Jan. 16, 2020

(87) PCT Pub. No.: WO2019/025750
PCT Pub. Date: Feb. 7, 2019

(65) Prior Publication Data

US 2020/0173738 A1 Jun. 4, 2020

(30) Foreign Application Priority Data

Aug. 4, 2017 (GB) ..... 1712577

(51) Int. Cl.
*F28F 9/02* (2006.01)
*F28D 21/00* (2006.01)

(52) U.S. Cl.
CPC ..... *F28F 9/0265* (2013.01); *F28D 21/0003* (2013.01); *F28F 9/0202* (2013.01);
(Continued)

(58) Field of Classification Search
CPC ..... F28F 9/0202; F28F 9/027; F28F 9/0265; F28F 9/0217; F28F 9/0207; F28F 2009/0287
See application file for complete search history.

(56) References Cited

U.S. PATENT DOCUMENTS 2,768,814 A * 10/1956 Frey ..... F28F 9/0265 165/139
5,400,853 A 3/1995 Wolters
(Continued)

FOREIGN PATENT DOCUMENTS

EP 1 843 117 10/2007
GB 844660 A * 8/1960 ..... F28F 9/0212
(Continued)

OTHER PUBLICATIONS

International Search Report and Written Opinion of the ISA for PCT/GB2018/051351, dated Jul. 30, 2018, 16 pages.
(Continued)

*Primary Examiner* — Devon Russell
(74) *Attorney, Agent, or Firm* — Nixon & Vanderhye P.C.

(57) ABSTRACT

A heat exchanger (4) comprises a heat exchanger core (20) comprising first fluid channels (22) and second fluid flow channels (24) for exchange of heat between the first and second fluids. First and second manifold portions (42, 44) are provided to guide the first and second fluids between the first and second fluid flow channels (22, 249 and first and second fluid interface portions (48, 49) which comprise fewer channels than the heat exchanger core (20). The first manifold portion (42) includes at least one tunnel portion (46) extending through the second manifold portion (44) at an angle to the direction of second fluid flow. Hence at least part of the first fluid is directed through the inside of the tunnel portion while the second fluid passes around the
(Continued)

outside of the tunnel portion. This enables more compact heat exchanger design.

18 Claims, 11 Drawing Sheets

(52) U.S. Cl.
CPC ..... *F28D 2021/0026* (2013.01); *F28F 2009/0287* (2013.01)

(56) References Cited

U.S. PATENT DOCUMENTS

2003/0192677 A1* 10/2003 Rong ..... F28F 9/0265 165/109.1
2004/0182554 A1* 9/2004 Bousquet ..... F28F 9/027 165/153
2005/0022982 A1* 2/2005 Dilley ..... F28F 9/0265 165/148
2008/0078537 A1* 4/2008 Desai ..... F28D 1/0435 165/140
2015/0129182 A1* 5/2015 Glass ..... F28F 9/028 165/159
2017/0146305 A1* 5/2017 Kuczek ..... F28F 9/0256

FOREIGN PATENT DOCUMENTS

JP 36-13195 8/1961
JP 02293595 A * 12/1990 ..... F28F 9/0209
JP 2966888 8/1999
JP 2002-350092 12/2002
JP 2004-108640 4/2004
WO 2005/040708 5/2005

OTHER PUBLICATIONS

Search Report for GB1712577.4, dated Jan. 23, 2018, 3 pages.
Office Action for JP Application No. 2020-504226 dated Mar. 28, 2022 and English translation, 6 pages.

* cited by examiner

HEAT EXCHANGER

This application is the U.S. national phase of International Application No. PCT/GB2018/051351 filed 18 May 2018, which designated the U.S. and claims priority to GB Patent Application No. 1712577.4 filed 4 Aug. 2017, the entire contents of each of which are hereby incorporated by reference.

The present technique relates to the field of heat exchangers.

A heat exchanger may include a core portion having first and second heat exchanging channels for exchange of heat between a first fluid in the first heat exchanging channels and a second fluid in the second exchanging channels. Such heat exchangers can be useful for a range of applications, for example as a recuperator for recovering heat from exhaust gas from an internal combustion engine or gas turbine. Other applications can be in power generation or ventilation systems.

At least some examples provide a heat exchanger comprising:

a heat exchanger core comprising first fluid flow channels and second fluid flow channels for exchange of heat between first fluid in the first fluid flow channels and second fluid in the second fluid flow channels;

a first manifold portion to direct the first fluid between the first fluid flow channels in the heat exchanger core and a first fluid interface portion comprising fewer first fluid flow channels than the heat exchanger core, and a second manifold portion to direct the second fluid between the second fluid flow channels and a second fluid interface portion comprising fewer second fluid flow channels than the heat exchanger core;

wherein the first manifold portion comprises at least one tunnel portion extending through the second manifold portion at an angle to the direction of second fluid flow through the second manifold portion, the first manifold portion is configured to direct at least part of the first fluid through the inside of the at least one tunnel portion and the second manifold portion is configured to direct the second fluid around the outside of the at least one tunnel portion.

At least some examples provide a system comprising: a combustor to generate heat by combusting a fuel, and a recuperator to recover heat from the exhaust gas output by the combustor, where the recuperator comprises a heat exchanger as described above.

At least some examples provide a method of manufacturing a heat exchanger comprising:

forming a heat exchanger core comprising first fluid flow channels and second fluid flow channels for exchange of heat between first fluid in the first fluid flow channels and second fluid in the second fluid flow channels;

forming a first manifold portion to direct the first fluid between the first fluid flow channels in the heat exchanger core and a first fluid interface portion comprising fewer first fluid flow channels than the heat exchanger core, and forming a second manifold portion to direct the second fluid between the second fluid flow channels and a second fluid interface portion comprising fewer second fluid flow channels than the heat exchanger core;

wherein the first manifold portion comprises at least one tunnel portion extending through the second manifold portion at an angle to the direction of second fluid flow through the second manifold portion, the first manifold portion is configured to direct at least part of the first fluid through the inside of the at least one tunnel portion and the second manifold portion is configured to direct the second fluid around the outside of the at least one tunnel portion.

At least some examples provide a computer-readable data structure representing a design of a heat exchanger as described above. A storage medium may store the a structure. The storage medium may be an non-transitory storage medium.

Further aspects, features and advantages of the present technique will be apparent from the following description of examples, which is to be read in conjunction with the accompanying drawings, in which:

FIG. 1 schematically illustrates an example a of heat exchanger used as a recuperator in a combined heat and power (CHP) system;

FIG. 2 shows an example of a heat exchanger core comprising first and second fluid flow channels;

FIG. 3 schematically illustrates a problem in implementing manifold portions for directing the first or second fluid between the heat exchanger core and first and second fluid interface portions;

Figure 1:
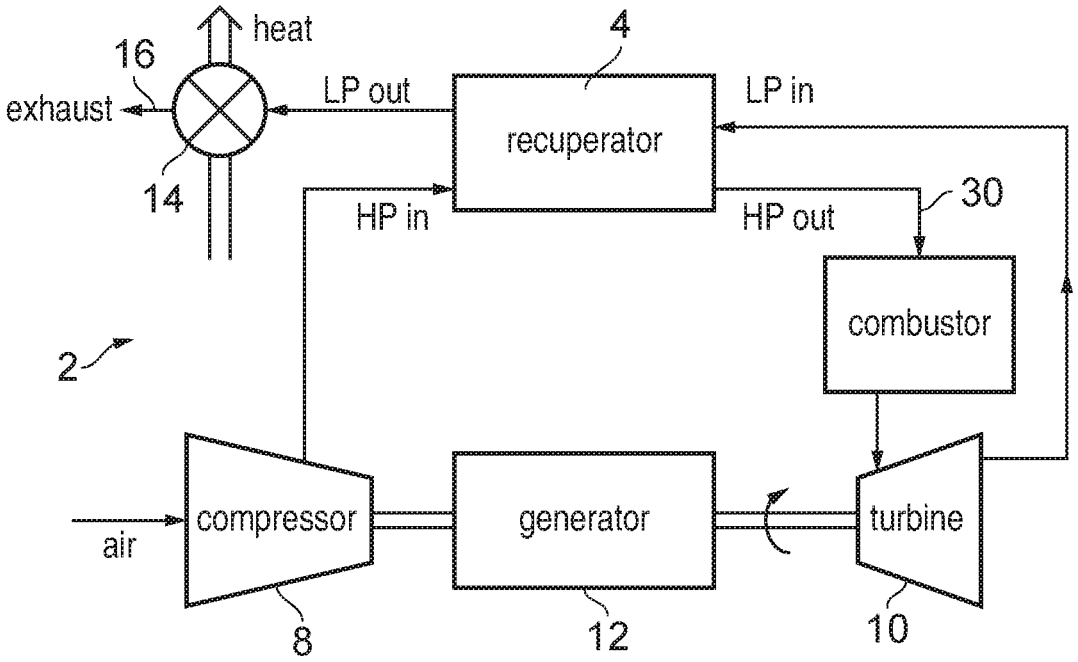

A heat exchanger comprising first and second fluid flow channels for exchange of heat between first fluid in the first fluid flow channels and second fluid in the second fluid flow channels can be useful for a range of engineering applications, for example in a micro turbine engine for automotive propulsion, or in a combined heat and power (CHP) system for providing electricity and heating supply for a home for example. Space for the system can often be at a premium and so there may be a desire to reduce the size of the heat exchanger. However, while the heat exchanger core may be able to be miniaturised there can be a challenge in implementing the manifold portions which direct the first and second fluid between the first and second fluid flow channels and interface portions for interfacing other elements of the system. Typically the first and second fluid flow channels may be interleaved in the core, but the first or second fluid entering or exiting the channels may need to be split from a common inlet, or gathered together to a common outlet, where the inlet or outlet has fewer flow channels than are provided within the heat exchanger core.

The locations of a first fluid interface portion and second fluid interface portion (which may interface with first/second fluid inlet/outlet conduits) may be constrained by objects surrounding the heat exchanger within the system in which the heat exchanger is to be used. For example within an automotive application, the heat exchanger may be provided under the bonnet or in the boot of a car or other vehicle, and so the panels bounding that space may constrain the locations at which the heat exchanger can interface with other elements of the micro turbine engine system or other engineering system in which the heat exchanger is used. Also, if the heat exchanger is to replace an existing heat exchanger then the locations of the first and second fluid interface portions may already have been defined and the heat exchanger may need to be designed to fit with those fixed locations of the first and second fluid interface portions. This can make it challenging to implement the manifold portion which directs fluid between the alternating many channels within the heat exchanger core and fewer channels within the first or second fluid interface portion. As well as the limitations imposed by the space in which the heat exchanger is to be used and the locations of the interfaces, the design for the manifold portion also should avoid disturbing the flow of fluid entering or exiting the heat exchanger core, e.g. there may be a desire to reduce pressure drop across the manifold portion and improve flow distribution into or out of the core. These competing requirements can be difficult to satisfy as the heat exchanger is reduced in size.

The heat exchanger described below has a first manifold portion to direct first fluid between the first fluid flow channels in the heat exchanger core and a first fluid interface portion comprising fewer first fluid flow channels under the heat exchanger core, and a second manifold portion to direct second fluid between the second fluid flow channels and a second fluid interface portion comprising fewer second fluid flow channels than the heat exchanger core. The first manifold portion comprises at least one tunnel portion which extends through the second manifold portion at an angle to the direction of second fluid flow through the second manifold portion. The first manifold portion directs at least part of the first fluid through the inside of the at least one tunnel portion and the second manifold portion directs the second fluid around the outside of the at least one tunnel portion.

Hence, the first and second manifold portions for guiding first and second fluid to or from the first and second fluid flow channels of the heat exchanger core are intertwined so that part of the first manifold portion extends in a tunnel through the second manifold portion across the second fluid flow direction. While one might expect that this may disturb the second fluid flow, surprisingly this is not the case, and in fact providing a structure to partition the flow of second fluid through the second manifold portion can help improve fluid flow properties as splitting the flow can reduce the likelihood of vortices. Meanwhile, directing at least part of the first fluid through the tunnel portion within the second manifold portion means that the first manifold portion does not need to have as large an extent in the area surrounding the outside of the second manifold portion in order to provide a given amount of fluid flow volume, so that the overall manifold can be made more compact while fitting with the constraints in the locations of the first and second fluid interface portions. While manufacturing the nested first and second manifold portions using traditional means such as casting or moulding could be challenging, the inventors recognised that with the use of additive manufacturing techniques it is possible to construct such a manifold where the first manifold portion extends in a tunnel that leads partially through the second manifold portion.

As well as improving the compactness of the manifolding, providing the tunnel portion through the second manifold portion also provides a greater opportunity for heat exchange between the first and second fluid, since there is an additional region in which the first and second fluids can exchange heat through the wall of the tunnel portion. Hence, the heat exchanger with this design can provide greater heat exchange efficiency, or for a given amount of heat exchange the size of the core portion can be reduced as there is more exchange of heat within the manifold portion.

This technique can be particularly useful in cases where the first fluid interface portion is on an opposite side of the second manifold portion to an entry/exit region of the first fluid flow channels of the heat exchanger core. For example, for compact design of the heat exchanger core the first fluids may need to flow into or out of the heat exchanger core at a given region, but the first fluid interface portion may be on the other side and it may be undesirable to disturb the flow of the second fluid by providing a less direct path for the second fluid within the manifold portion. By using the tunnel portion in the first manifold portion as discussed above, the second fluid can still flow relatively directly through the second manifold portion, while the first fluid may be directed through the tunnel. The first manifold portion may direct the first fluid around a turn between the first fluid flow channels of the heat exchanger core and the at least one tunnel portion or between the first fluid interface portion and the at least one tunnel portion. The turn may comprise a turn of at least 45 degrees for example. Hence, an angle between a direction of first fluid flow through the at least one tunnel portion and a direction of second fluid flow through the second manifold portion may be at least 45 degrees. With this approach, the first fluid can reach the first fluid interface portion on the opposite side of the second manifold portion to the entry/exit region of the heat exchanger column without needing to direct all of the first fluid around the outside of the second manifold portion. The first fluid can be directed around the turn and through the tunnel within the second manifold portion to reach the other side of the second manifold portion, enabling the overall manifolding to be made more compact.

The tunnel portion may be shaped to assist with the flow of second fluid through the second manifold portion. For example, the leading edge of at least one tunnel portion in the direction of second fluid flow may be shaped to direct the second fluid around the outside of the at least one tunnel portion. In particular the leading edge may be shaped to split the second fluid and divert part of the second fluid on one side of the tunnel portion and part on the other side. For example, the leading edge of the at least one tunnel portion may have a round, oval, diamond or aerofoil-shaped cross-section. By shaping the tunnel portion this way, the flow of second fluid may stick to the outside of the tunnel portion to reduce the likelihood of vortices forming within the second manifold portion, which can improve the efficiency of fluid flow and hence the performance of the heat exchanger.

An aerofoil-shaped tunnel portion can be particularly useful. Hence the tunnel portion may comprise a hollow aerofoil stretching across the inside of the second manifold portion which has multiple functions, firstly providing a flow path for the first fluid through the second manifold portion to reduce the size of portions of the first manifold portion outside the second manifolding, and secondly assisting with the efficiency of the second fluid flow. Hence, by providing at least one tunnel portion with an aerofoil-shaped cross-section with the leading edge of the aerofoil-shaped cross-section pointing towards either the second fluid interface portion (in cases where the second fluid is flowing into the heat exchanger core from the second manifold portion) or towards the second fluid flow channels of the heat exchanger core (in cases where the second fluid is flowing out of the heat exchanger core and through the second manifold portion to the second fluid interface portion), the performance of the heat exchange as a whole can be improved. Manufacturing such hollow aerofoil-shaped tunnels can be challenging using conventional manufacturing techniques but with additive manufacture this is possible.

Some embodiments may provide only a single tunnel portion of the first manifold portion extending through the second manifold portion. However in other examples two or more such tunnel portions could be provided.

In some embodiments, all the first fluid flowing through the first manifold portion may flow through the at least one tunnel portion. Hence, there need not be any other portion for guiding first fluid between the first fluid flow channels of the heat exchanger core and the first fluid inlet/outlet region.

However, in other embodiments, as well as the tunnel portion, the first manifold portion may also comprise an outer portion which directs part of the first fluid around the outside of the second manifold portion between the first fluid flow channels of the heat exchanger core and the first fluid interface portion. Hence, as well as guiding part of the first fluid through the tunnel within the second manifold portion, the first manifold portion also may include some channels around the outside of the second manifold portion so that the overall volume or fluid flow rate can be increased. By providing the tunnel portion the size of the outer portion can be reduced, as otherwise a larger channel would need to wrap around the outside of the second manifold portion.

The heat exchanger can be manufactured with at least one fin bridging between an outer surface of the second manifold portion and an inner surface of the first manifold portion which lies outside the second manifold portion. Such fins, in addition to providing mechanical strength to the heat exchanger to increase robustness, may also help to improve the flow of first fluid through the manifold by partitioning the flow to reduce the incidence of vortices. Also such fins can be useful for enabling the design to be manufactured by additive manufacture since they provide additional supports upon which other parts of the design can be built by laying down successive layers of material. Also, the fins can provide additional surfaces for promoting heat exchange between the fluids.

In one example at least one separator grid may be disposed inside the second manifold portion to partition the flow of second fluid flowing through the second manifold portion. The second manifold portion may need to guide fluid between a region of the heat exchanger core having a first cross-section area and the second fluid interface portion having a second cross-sectional area, where the second cross-section area may be less than the first cross-sectional area. Typically, to provide efficient fluid flow with reduced turbulence, it may be desirable to avoid the manifold expanding or contracting the cross-sectional area too quickly. However, this desire may conflict with the requirement for the overall heat exchanger to be compact in order to fit within a limited space. By providing the separator grid, this splits the flow of second fluid to reduce the chance of large vortices swirling within the second manifold portion, enabling the second manifold portion to expand or contract the cross-sectional area faster, and hence enabling a more compact heat exchanger design. In one example, the separator grid could be manufactured across a portion of the second manifold portion other than the portion containing at least one tunnel portion from the first manifold portion. However, manufacturing the separator grid by additive manufacture can be simpler if there are supports for building up the grid layer by layer, and so it can be particularly useful for at least one separator grid to be coupled to an outer surface of the at least one tunnel portion, as this makes manufacture simpler. In one example, each space between the side of the tunnel portion and the side of another tunnel portion or the inner surface of the second manifold portion could be provided with a separator grid stretching across that space.

While the heat exchanger is described as operating with a first fluid and a second fluid above, it is also possible for heat exchangers to operate with three or more fluids, in which case the first and second fluids described above may be any two of the three or more fluids. Hence, in addition to the first and second manifold portions, there could also be a third manifold portion for routing third fluid to or from third fluid flow channels interleaved with the first and second fluid flow channels in the heat exchanger core (or further manifold portions for additional fluids).

The heat exchanger may comprise an integrated mass of consolidated material, for example formed by additive manufacture. This contrasts with heat exchangers manufactured from multiple separate components. Hence, the first and second manifold portions may be formed together as one entity from a single body of material. The heat exchanger core could be formed as a separate entity to the manifold portions which is laid alongside the first/second manifold portions in the assembled heat exchanger, or alternatively the core and first/second manifold portions could all be formed together as one entity from a single body of material.

The first and second fluid interface portions discussed above may in some examples simply comprise a tube or other conduit by which the first or second fluid is guided to or from the heat exchanger. The tube could have a circular or non-circular cross section. In some cases the first and second fluid interface portions may each comprise a single channel, i.e. a single tube or conduit which conveys all of the first or second fluid being directed to or from the heat exchanger. However, in other cases the first or second fluid interface portion may comprise more than one channel, for example the tube may be internally subdivided. Hence in general the first and second fluid interface portions may be any portions which comprise fewer channels for the first or second fluid respectively than are provided within the heat exchanger core. Hence, in general the first and second manifold portions are the portions which combine fluid from a larger number of channels to a smaller number of channels on exit from the heat exchanger core or which splits fluid from a smaller number of channels to a larger number of channels on entry to the heat exchanger core. In some cases the first and second manifold portions could also provide a change in the cross-sectional area or cross-sectional shape of the channel used to convey the first or second fluid.

The heat exchanger described above can be used in a range of engineering systems. However, it can be particularly useful for a system comprising a combustor for generating heat by combusting a fuel and a recuperator for recovering heat from the exhaust gas output by the combustor. The recuperator may comprise the heat exchanger as discussed above. Compactness can often be an important requirement for such systems.

In some cases the system may also comprise a turbine driven by the exhaust gas output by the combustor which may power a generator, and also a compressor for compressing the fluid being input into the combustor. The recuperator may use the waste heat in the exhaust gas from the combustor to pre-heat the air being supplied to the combustor so that the combustor does not need to expend as much energy heating the air to the temperature at which combustion is possible. Hence, the second fluid may comprise the exhaust gas from the combustor and the first fluid may comprise the air to be heated by the exhaust gas before being supplied to the combustor. The heat exchanger discussed above can be useful for such a system because the exhaust gas may be hotter than the air being heated and so it may be desirable to provide the manifolding for the first fluid (pre-heated air) on the outside of the second manifold portion which conveys the exhaust gas as the second fluid, so that the pre-heated air can provide some insulation to reduce the amount of heat lost to the surroundings from the exhaust gas and allow more heat to be recovered. However, wrapping the first manifold portion entirely around the outside of the second manifold portion would increase space and by providing a tunnel through the second manifold portion as discussed above this enables greater efficiency of space usage while also providing efficient fluid flow and reducing pressure drop.

A corresponding method of manufacturing a heat exchanger may be provided, in which the heat exchanger core, first manifold portion and second manifold portion are formed with the configuration discussed above. For example the heat exchanger can be formed by additive manufacture. In additive manufacture, an article may be manufactured by successively building up layer after layer of material in order to produce an entire article. For example the additive manufacture could be by selective laser melting, selective laser centring, electron beam melting, etc. The material used for the core portion and the first and second manifold portions can vary, but in some examples may be a metal, for example aluminium, titanium or steel or could be an alloy. In some cases the heat exchanger core and the first and second manifold portions may be formed in one single process whereby the layers making up the respective parts of the heat exchanger may be laid down successfully by additive manufacture. Hence, the first and second manifold portions in particular may be manufactured together since they are intertwined.

The additive manufacture process may be controlled by supplying an electronic design file which represents characteristics of the design to be manufactured, and inputting the design file to a computer which translates the design file into instructions supplied to the manufacturing device. For example, the computer may slice a three-dimensional design into successive two-dimensional layers, and instructions representing each layer may be supplied to the additive manufacture machine, e.g. to control scanning of a laser across a powder bed to form the corresponding layer. Hence, in some embodiments rather than providing a physical heat exchanger, the technique could also be implemented in a computer-readable data structure (e.g. a computer automated design (CAD) file) which represents the design of a heat exchanger as discussed above. Thus, rather than selling the heat exchanger in its physical form, it may also be sold in the form of data controlling an additive manufacturing machine to form such a heat exchanger. A storage medium may be provided storing the data structure.

FIG. 1 schematically illustrates an example of a system 2 comprising a heat exchanger 4. In this example the system 2 comprises a micro turbine engine used for combined heat and power (CHP) for home energy supply. A combustor 6 combusts a fuel (e.g. gas). The intake air for the combustor is compressed by a compressor 8 which is driven by a turbine 10 driven by the exhaust gas from the combustor 6. The turbine and compressor 8 are mounted on a common shaft together with a generator 12 which generates electrical power based on the rotation of the turbine. The electrical power can be supplied as part of the electricity supply for home.

The exhaust gas from the combustor 6 having driven the turbine 10 is passed to the recuperator 4 which comprises a heat exchanger with alternating channels for the exchange of heat between first and second fluids. The heat in the exhaust gas is used to pre-heat the compressed air intake for the combustor so that the air is at a higher temperature upon entering the combustor and so the combustion efficiency of the combustor 6 can be improved. Having passed through the recuperator 4, the exhaust gas still contains some heat which can be recovered for example to heat the domestic water supply or central heating within the home at heating element 14, and then the exhaust gas is exhausted to the outside at vent 16.

The combustor intake air entering the recuperator 4 is at higher pressure than the exhaust gas from the combustor 6 and turbine 10, since the intake air has been compressed by the compressor 8 and the exhaust gas has been expanded by the turbine 10. Hence, the intake air can be referred to as the high pressure (HP) fluid and the exhaust gas referred to as low pressure (LP) fluid. The HP fluid can also be referred to as the cold fluid and the LP fluid as the hot fluid since the exhaust gas from the combustor 6 will typically be hotter than the intake air. However, if the recuperator 4 is relatively efficient then by the time the LP fluid leaves the recuperator and the HP fluid leaves the recuperator these may be at approximately similar temperatures and so the temperature difference may not be significant. Hence, for avoidance of doubt the terms HP and LP fluid will be used herein.

It will be appreciated that FIG. 1 is just one possible example of an engineering system which may use such a recuperator and other micro turbine technologies could also use a similar recuperator.

The recuperator 4 comprises a heat exchanger core portion 20 which includes a number of alternating heat exchanging channels 22, 24 for the HP and LP fluids respectively. In this example the heat exchanger core 20 is a counter-flow heat exchanger so that the HP and LP fluids (first and second fluids) flow through the heat exchanger core in opposite directions. However, the techniques discussed here can also be applied to a parallel-flow heat exchanger in which the HP and LP fluids flow in corresponding directions through the heat exchanger channels, or a cross-flow heat exchanger in which the HP and LP fluids flow in directions which are not parallel to each other. Nevertheless, heat exchanger efficiency can often be greater in a counter-flow heat exchanger.

Figure 2:
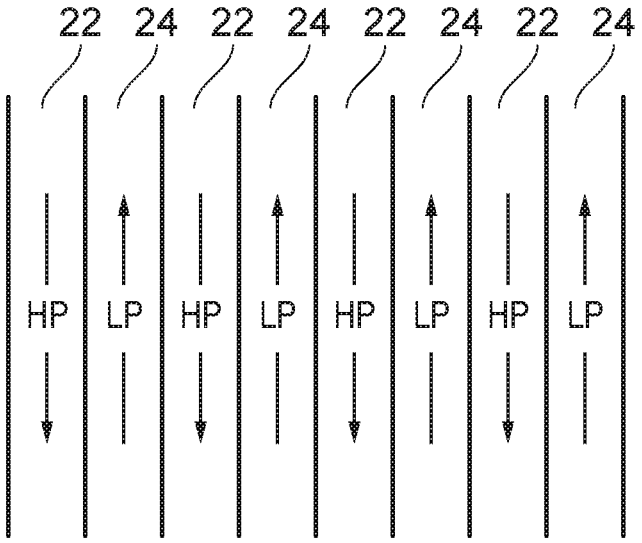
Figure 3:
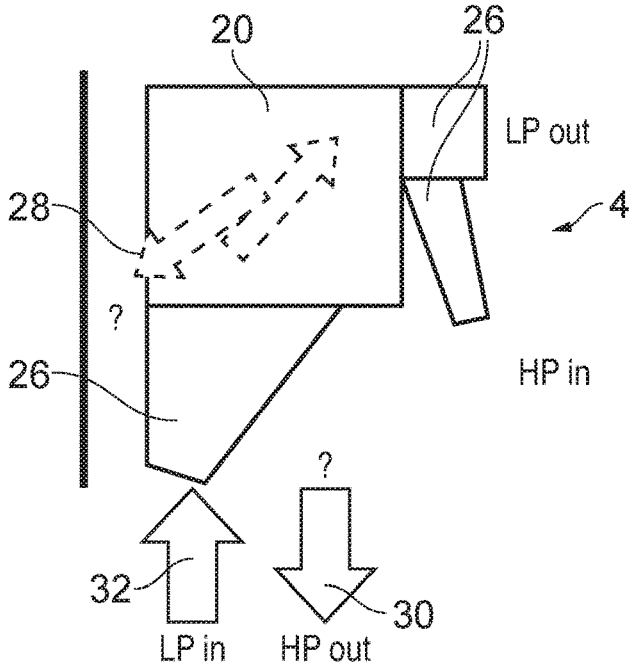

FIG. 3 schematically illustrates some challenges which may arise when attempting to implement such recuperator 4 in a relatively space-constrained environment. The heat exchanger core 20 is provided with alternating first and second fluid flow channels 22, 24 as in FIG. 2. To most efficiently implement the heat exchanger core 20, it may be desired for the HP or LP fluid to enter on one side of the heat exchanger and leave on the other side. However, this can make implementing the manifolding 26 for guiding the LP and HP fluids to or from the heat exchanger more complex. In general, the manifolding 26 gathers together the HP or LP inlet fluid from a single conduit (or relatively few conduits) and splits the fluid between the multiple interleaved heat exchanger channels 22, 24 for the appropriate fluid on one side of the heat exchanger core, and recombines the fluid from multiple channels into fewer channels on the other side of the heat exchanger core. FIG. 3 shows a counter-flow heat exchanger where LP in and HP out manifolding 26 is provided on one side of the heat exchanger, and LP out and HP in manifolding on the other side, but in a parallel flow heat exchanger the LP in and HP in manifolding would be on the same side of the heat exchanger and the LP out and HP out manifolds on the other side.

As mentioned above, for compact heat exchanger core design it may be desirable for the HP outlet region 28 of the heat exchanger core 20 to be on one side of the heat exchanger core (shown on the left side of FIG. 3). However, space constraints or constraints imposed by the location of other components of the system 2 may mean that the HP outlet interface 30 (e.g. a conduit 30 leading to the combustor 6 as shown in FIG. 1) may need to be on the opposite side from the region 28 which the HP fluid leaves the heat exchanger core 20. Also, for most efficient flow of the hotter LP fluid entering the heat exchanger core it may be desirable for the manifolding associated with the LP inlet 32 to be relatively straight and directly diffuse the LP fluid to the entrance of the core portion 20. Designing manifolding to bridge between the heat exchanger core 20 and fixed locations of the LP inlet 32 and HP outlet 30 while reducing pressure drop, improving flow distribution into the core and enabling the overall system to fit within the given volume, can be challenging.

Figure 4:
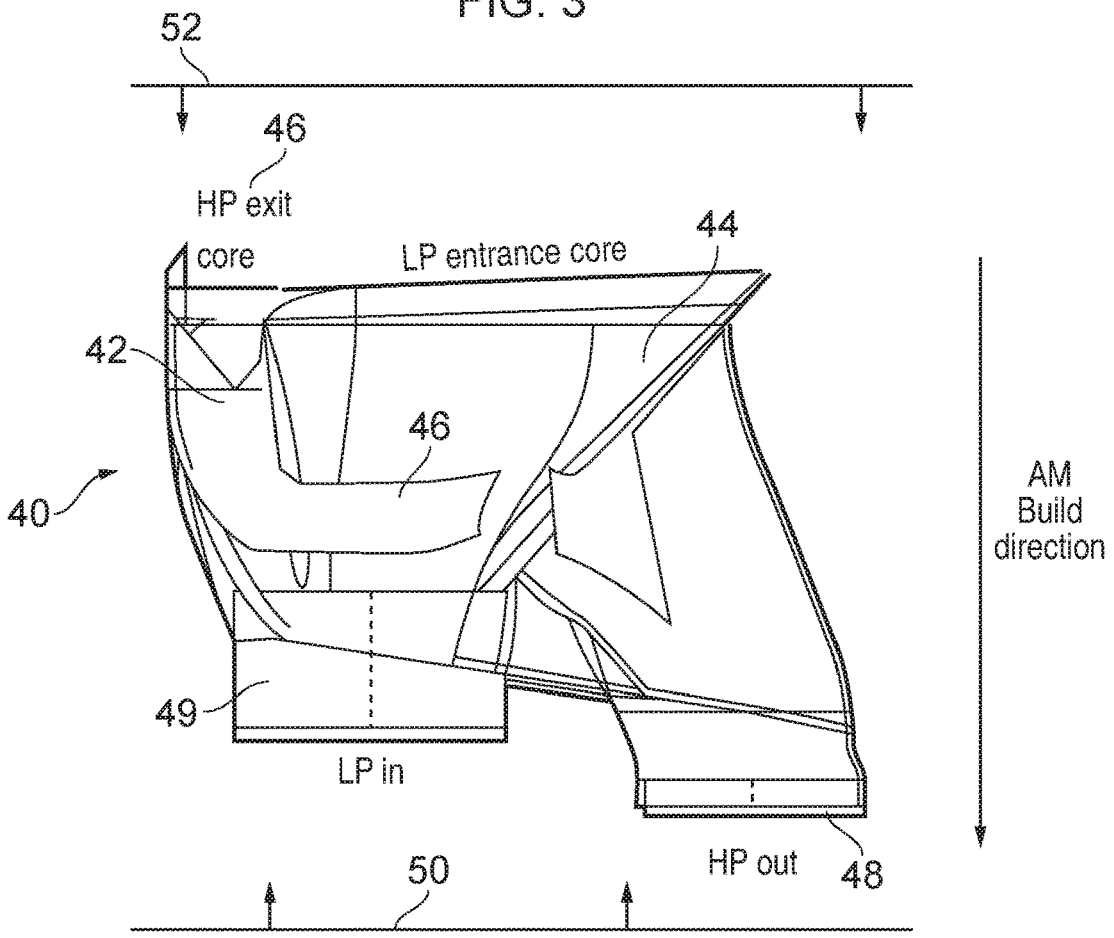
FIG. 4 shows an example of a manifold section comprising a first manifold portion and a second manifold portion in which the first manifold portion includes at least one tunnel portion extending through the second manifold portion.

FIG. 4 schematically illustrates an example of a manifold portion 40 comprising a first manifold portion 42 and a second manifold portion 44. The first manifold portion 42 is used for the HP fluid and the second manifold portion 44 for the LP fluid. The LP manifold 44 provides a direct diffuser to the LP entrance of the heat exchanger core 20. On the other hand, the HP manifold portion 42 wraps around the LP manifold portion 44 and also includes a tunnel portion 46 extending through the LP manifold at an angle to the direction of LP flow in order to bridge between the HP exit region 46 of the core on one side of the LP manifold 44 and the HP outlet interface 48 on the other side of the LP manifold portion 44. Hence the HP fluid flows both around and through the LP manifold. This enables the manifold portion 40 on the LP inlet and HP outlet side of the heat exchanger core to be made more efficiently with reduced space while also improving flow properties.

Figure 5:
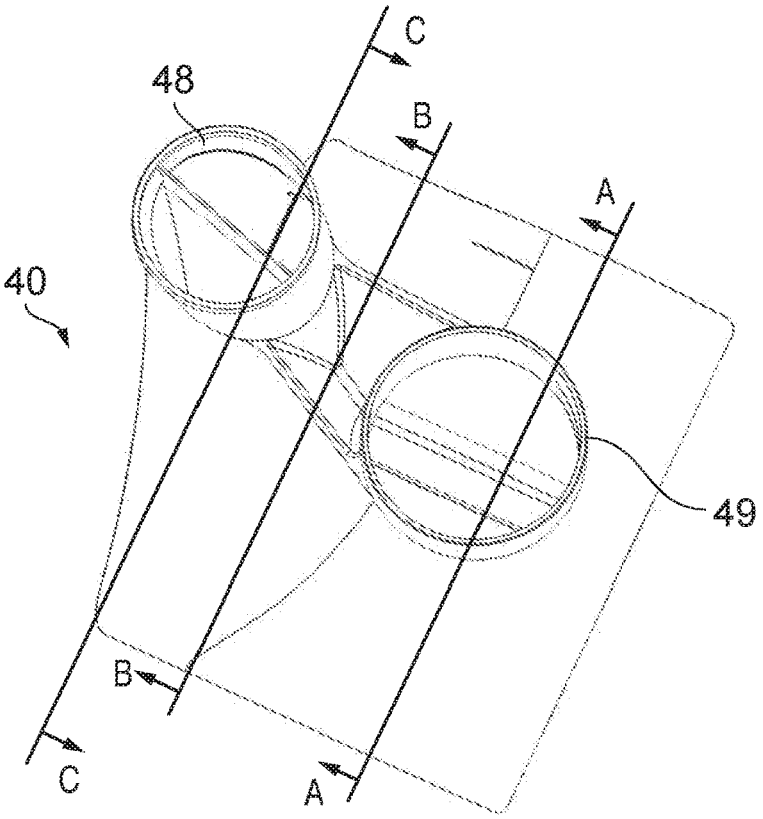
FIGS. 5 and 6 show views of the manifold portion of FIG. 4 from opposite sides.
Figure 6:
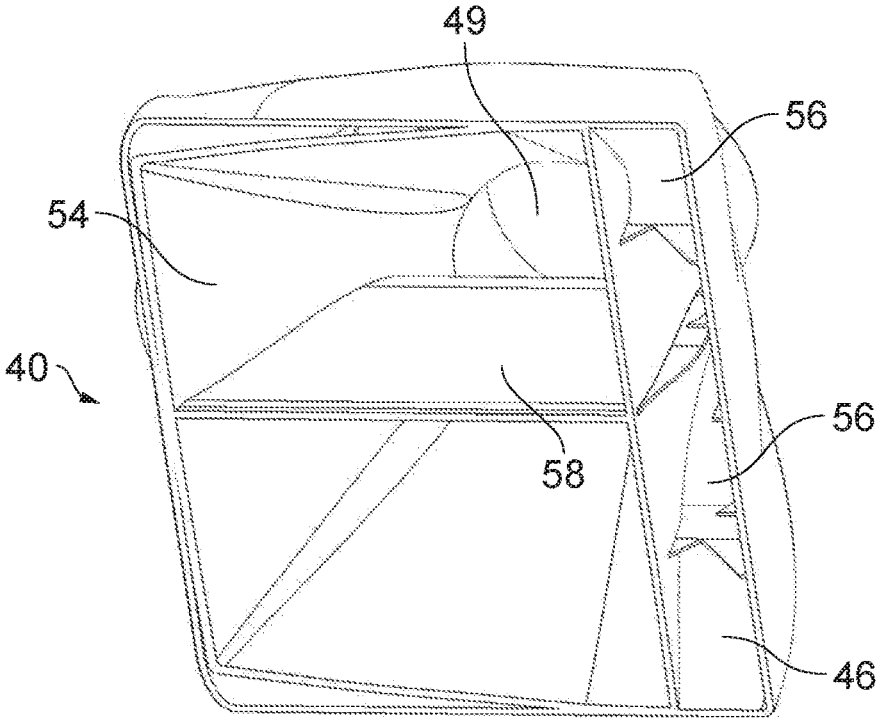

FIGS. 5 and 6 show views of the manifold portion 40 when viewed from the sides 50 and 52 respectively. That is, FIG. 5 shows the view from side 50 on the LP and HP inlet/outlet interface side, while FIG. 6 shows a view from the side 52 closest to the heat exchanger core 20. As shown in FIG. 5, the HP outlet interface portion 48 and LP inlet interface 49 correspond to collar portions which can fit over or inside a tubular conduit for supplying the LP fluid to the LP inlet interface 49 or conveying the HP fluid from the HP outlet interface 48.

As shown in the view in FIG. 6 of the manifold portion 40, the HP exit region 46 is on one side of the manifold, with most of the remaining cross-section coverall area of the manifold portion corresponding to the LP entrance region of the core. The opening of the LP inlet interface 49 is visible at the back of the view shown in FIG. 6. A dome-shaped funnel region 54 bridges between the smaller vent 49 and the larger aperture at the LP entrance region.

As shown in FIG. 6, the HP exit region 46 supplies the HP fluid to outer channels 56 which extend around the outside of the dome shaped portion 54 of the LP manifold as well as through tunnel portion 58 which extends across the LP manifold portion. Hence, the HP flow is directed both around and through the LP manifold with the fluid from the HP flow undergoing a turn as it passes into the tunnel portion.

Figure 7:
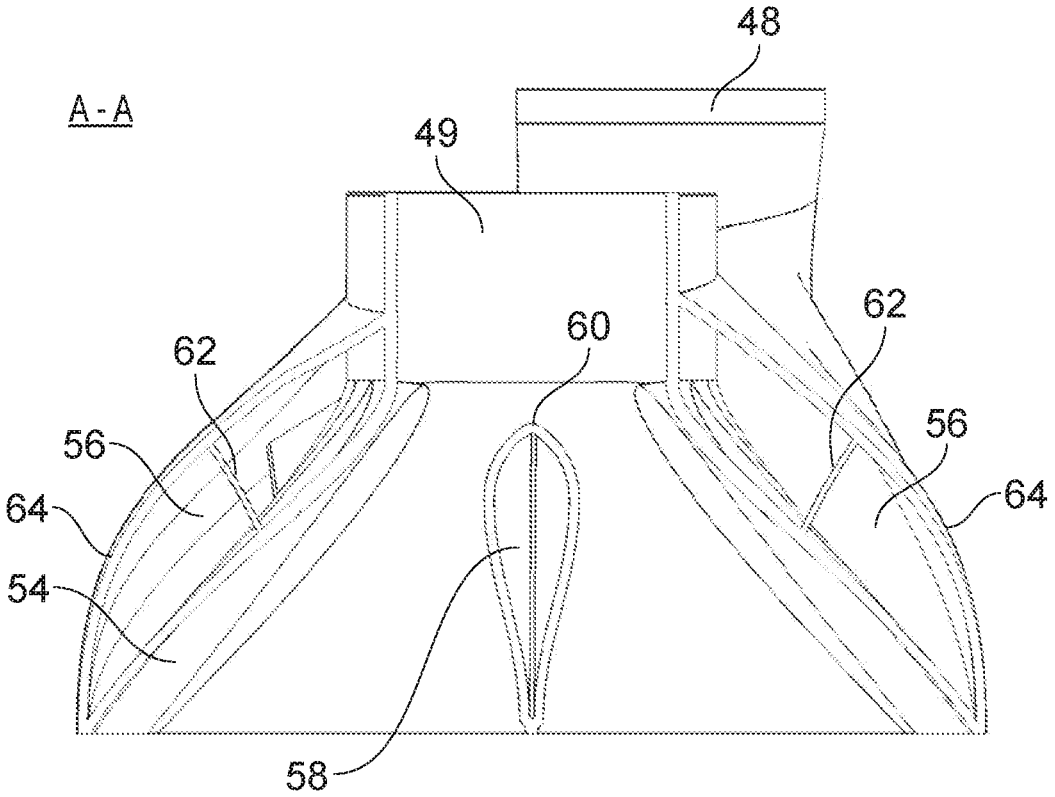
FIGS. 7, 8 and 9 illustrate cross-section views of the manifold portions in the planes A-A, B-B and C-C illustrated in FIG. 5 respectively.
Figure 8:
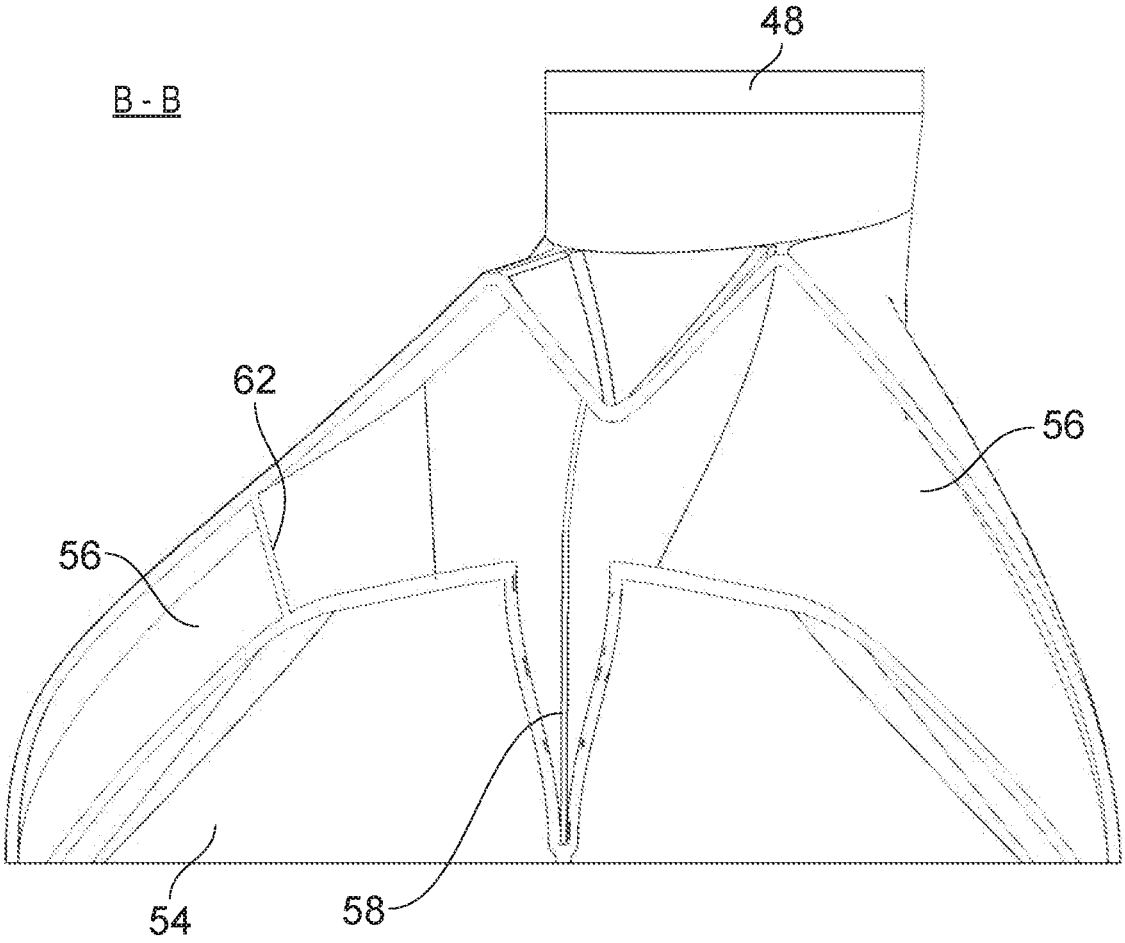
Figure 9:
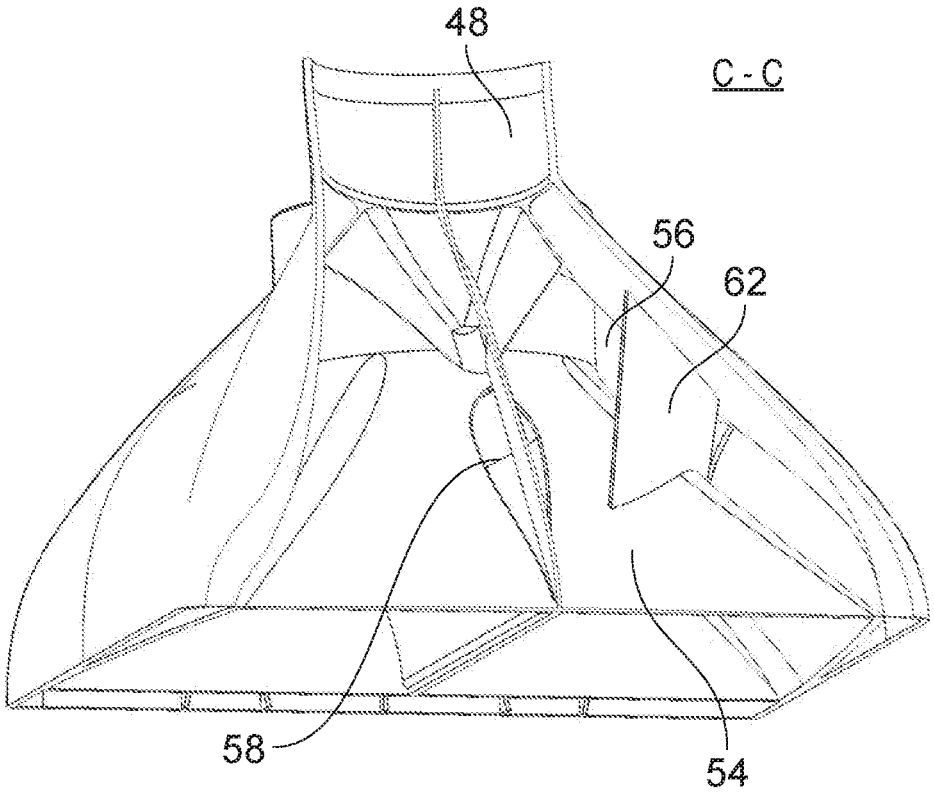

The tunnel portion and outer regions of the HP manifold can be seen more clearly in the cross-section a views in FIGS. 7 to 9. The view in FIG. 7 is taken in the plane and direction shown as A-A in FIG. 5. The view in FIG. 8 is shown in plane B-B and the view in FIG. 9 is shown in plane C-C in FIG. 5.

As shown in FIG. 7 the tunnel portion 58 has a cross-section corresponding to an aerofoil-shape with a leading edge 60 pointing towards the LP fluid inlet interface 49 so that the LP fluid flowing into the manifolds reaches the leading edge 60 of the aerofoil-shaped tunnel first and this splits the flow of the second fluid so that the second fluid flows on either side of the outside of the tunnel portion 58. The LP fluid will tend to stick to the outer surface of the tunnel which can be useful for enabling more smooth flow of fluid through the manifold to reduce the turbulence. Of course, if the manifolding was being used for a heat exchanger in which the LP fluid is flowing out of the heat exchanger through the manifold then the aerofoil shape could be oriented the other way so that the leading edge 60 would point towards the heat exchanger core. Alternatives to an aerofoil-shape could include an oval shape, circular shape or diamond shape with the apex of the circle, oval or diamond pointing towards the fluid inlet direction.

In addition to the tunnel portion to 58, the HP manifold also includes the outer portions 56 which provide channels for guiding the fluid around the outside of the dome shaped outer surface 54 of the LP manifold portion. A number of fins 62 are providing bridging between the outer surface of the LP manifold portion 54 and the inner surface of the outside boundary 64 of the outer channels 56 of the HP manifold.

As shown in the cross-section view in FIG. 8 taken in plane B-B the outer channels and the tunnel portion 58 eventually recombine once the HP fluid has flowed beyond the end of the LP inlet 49 and then is guided up towards the HP outlet inlet 48. This can be seen also in FIG. 9 showing the view in plane C-C looking back in the opposite direction to the view shown in FIGS. 7 and 8. The HP fluid flowing around the outside of the dome 54 and the fluid flowing through the tunnel 58 are recombined and directed through the HP outlet 48 to any conduit provided to guide the HP fluid to the combustor 6.

Figure 10:
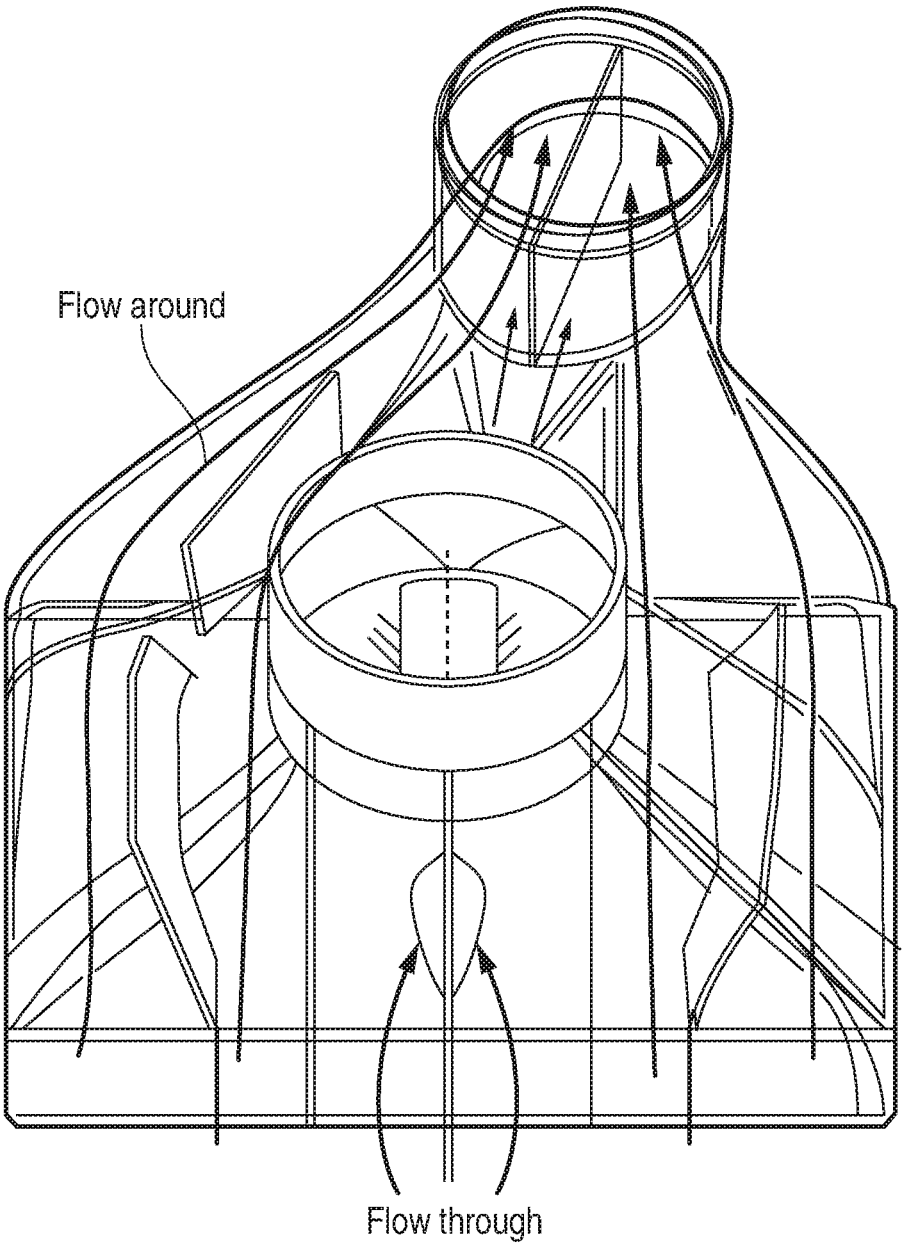
FIG. 10 illustrates how the first fluid is guided both around and through the second manifold portion by the first manifold portion.

Hence, as shown in FIG. 10 there is a flow of HP fluid both around the outside of the second manifold portion provided for the LP fluid and also through the second manifold portion through the tunnel which provides a more compact design while also improving fluid flow properties.

While the example shown above provides a single tunnel portion, in other cases two or more tunnels could be provided. While the tunnel extends at approximately 90 degrees to the fluid flow direction of the LP fluid directed through the LP manifold, this is not essential and in other examples the tunnel could be angled from the 90 degree angle shown in the diagrams. In general the tunnel may extend at an angle of at least 45 degrees relative to the HP fluid flow direction. The fins help with fluid flow as well providing stiffness. In some cases some external fins could also be built on the outside of the manifold portion 40 to provide further mechanical stiffness.

In addition to improving the compactness and fluid flow properties there is additional heat transfer since the flow of HP fluid around and through the LP manifold provides potential for additional heat transfer. The fins 62 to also contribute to the heat transfer area since the hotter LP fluid may provide heat which may conduct through the fins 62 dome-shaped wall 54 and assist with heating the HP fluid.

Hence, depending on system requirements, this may enable a smaller heat exchanger core 20 to be used to in order to provide a certain amount of heat exchange, since there is more heat exchange within the manifold regions.

While FIGS. 4 to 10 show a manifold portion for the LP inlet and HP outlet side of the heat exchanger core, a similar arrangement could also be used on the LP outlet and HP inlet side (although this is not essential as sometimes the space constraints may be more significant on one side of the core rather than the other). Also, the designation of the first and second manifold regions as LP inlets and HP outlets are just one example and in other cases depending on the direction of fluid flow through the heat exchange this could be LP inlet and HP inlet or LP outlet and HP outlet.

Figure 11:
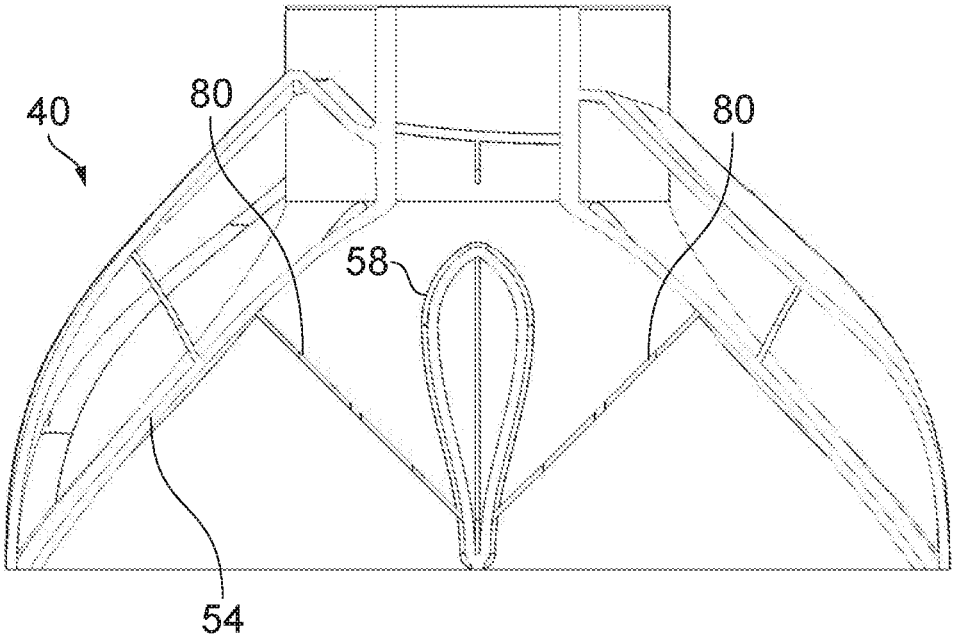
FIGS. 11 and 12 show a second example of the manifold portion in which a separator grid is provided within the second manifold portion.
Figure 12:
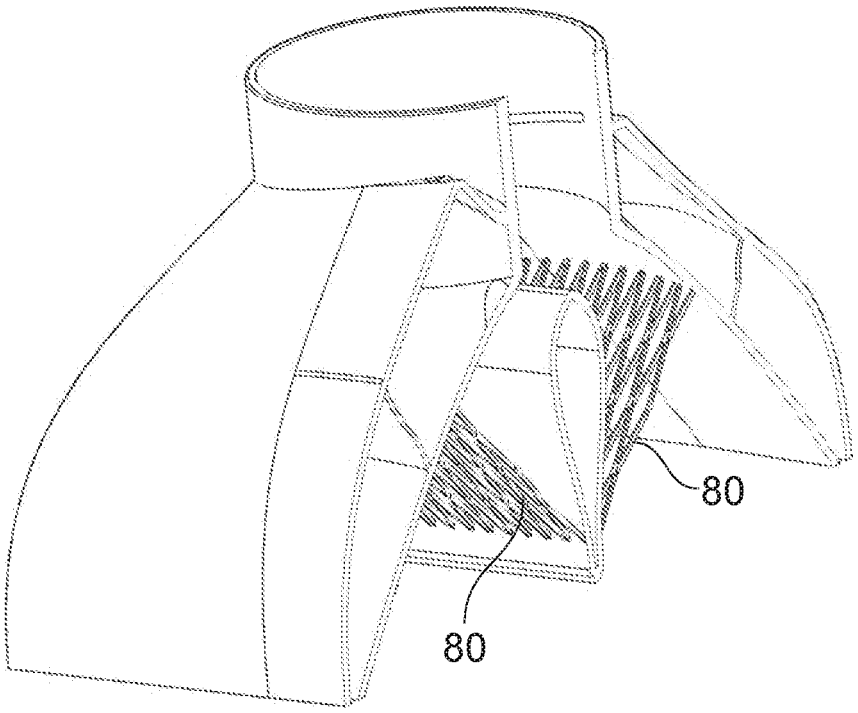

FIG. 11 shows a second embodiment of the manifold portion 40 which is the same as the one shown in FIGS. 4 to 10 except that an additional separator grid 80 is built across the second manifold portion between the outer surface of the tunnel region 58 and the inner service of the dome shaped outer boundary of the second manifold portion. In other examples the separator could be across the portion of the second manifold portion which lies above or below the tunnel region 58 so it is not essential to bridge to the tunnel. However, the tunnel can provide a good support for the building the separator grid by additive manufacture. The separator grid can be seen more clearly in the view shown in FIG. 12 which represents a cross-section view at an angle, showing how the grid 80 corresponds to a lattice of interconnected members. The separator grid comprises a number of slots or holes and the cross bars of the grid split the flow of the second fluid as it passes through the second manifold portion. This is useful because it enables the second manifold to be made more compact in bridging between a smaller and larger cross sectional area in less space than would be the case without the grid. Typically if the fluid is expanded or compressed in area too quickly then there may be more turbulence and greater incidence of vortices which can disturb the flow. The separator grid 80 prevents this by partitioning the flow and reducing the chance that as large a mass of fluid interacts with each other. Other than the additional separator grid the example of FIGS. 11 and 12 is the same as discussed above.

Figure 13:
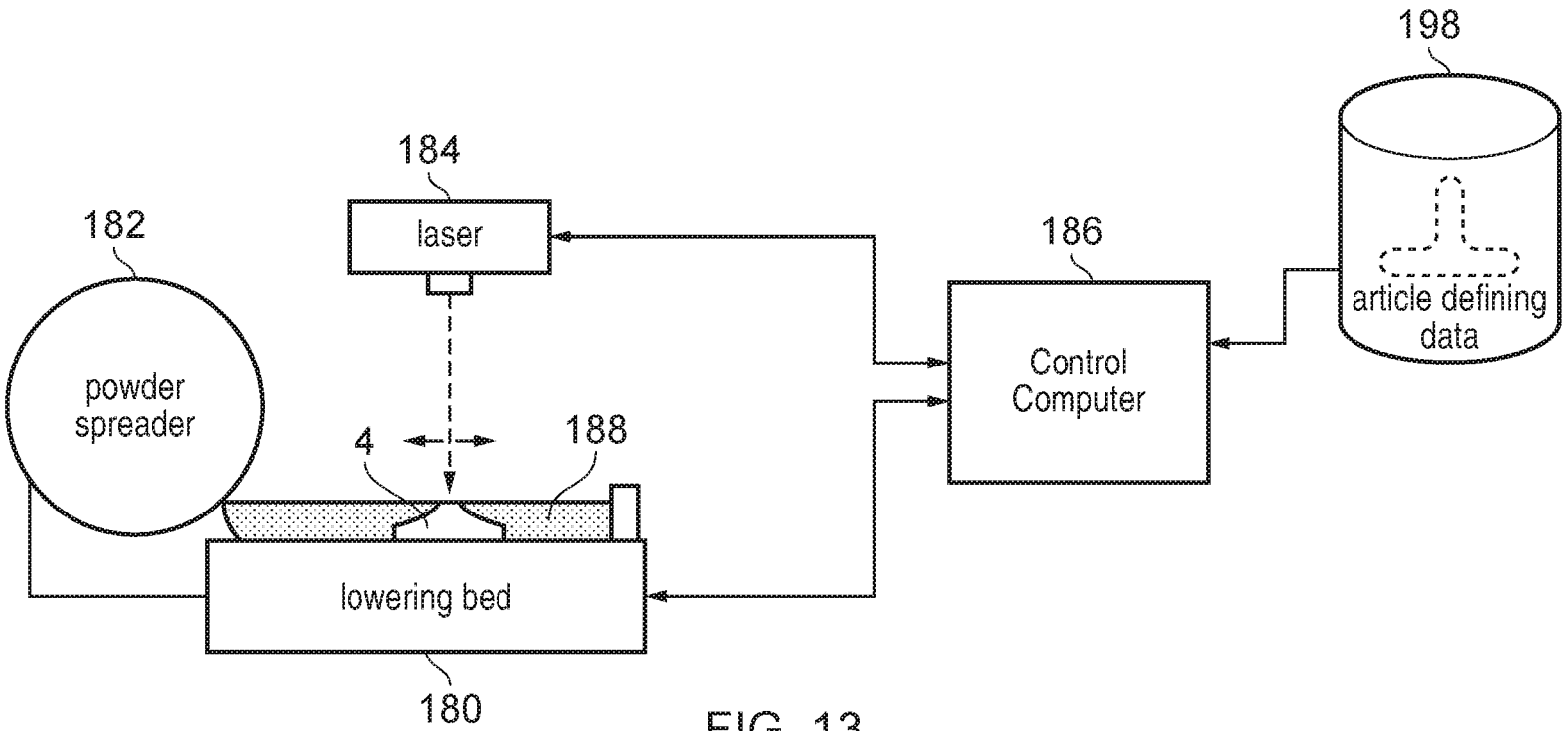
FIG. 13 illustrates one example of manufacturing equipment for manufacturing the heat exchanger by additive manufacture.

FIG. 13 schematically illustrates an example of additive manufacture. In this example, laser fused metal powder 188 is used to form an article 4 such as the heat exchanger described above. The article 4 is formed layer-by-layer upon a lowering powder bed 180 on top of which thin layers of metal power to be fused are spread by a powder spreader 182 prior to being melted (fused) via a scanning laser beam provided from a laser 184. The scanning of the laser beam via the laser 184, and the lowering of the bed 180, are computer controlled by a control computer 1. The control computer 186 is in turn controlled by a computer program (e.g. computer data defining the article 4 to be manufactured). This article defining data is stored upon a computer readable non-transitory medium 198. FIG. 13 illustrates one example of a machine which may be used to perform additive manufacture. Various other machines and additive manufacturing processes are also suitable for use in accordance with the present techniques, whereby manifold portions for a heat exchanger are manufactured with the first manifold section including a tunnel section extending through the second manifold section as discussed above. For the specific design shown in FIG. 4, the build direction for additive manufacture is illustrated by the arrow on the right hand side. By building the manifold portion starting with the layer closest to the entrance/exit of the heat exchanger core, it is possible to build the rest of the manifold portion without an upper layer needing to extend beyond a lower layer by an angle of more than 45 degrees from the vertical, and there is greater support for upper layers by lower layers, to make it more practical to make the component by additive manufacture.

Figure 14:
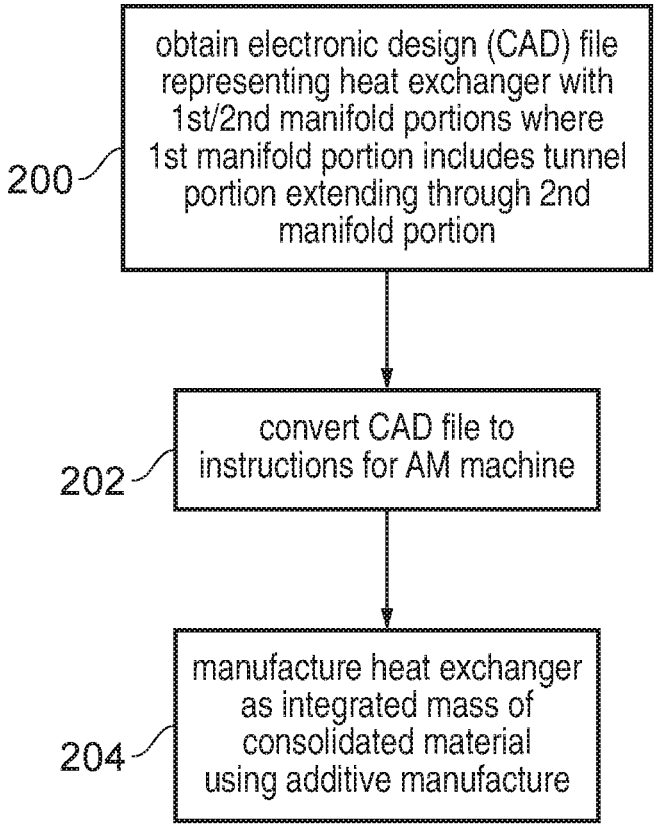
FIG. 14 is a flow diagram illustrating a method of manufacturing a heat exchanger.

FIG. 14 shows a method for manufacturing a heat exchanger. At step 200 a computer automated design (CAD) file is obtained. The CAD file provides a data structure which represents the design of a heat exchanger comprising a first manifold portion and second manifold portion, where the first manifold portion includes at least one tunnel portion extending through the second manifold portion at an angle to the direction of second fluid flow. For example, obtaining the CAD file at step 200 may comprise a designer generating a three-dimensional (3D) model of the heat exchanger from scratch, or could comprise reading an existing design from a recording medium or obtaining the CAD file via a network. The design file may represent the 3D geometry to be manufactured.

At step 202 the CAD file is converted to instructions for supplying to an additive manufacturing machine. The instructions control the additive manufacturing machine to deposit or form respective layers of material, which are built up layer by layer to form the overall heat exchanger. For example, the 3D design represented by the CAD file may be sliced into layers each providing a two-dimensional representation of the material to be formed in the corresponding layer.

At step 204 the converted instructions are supplied to an additive manufacturing machine which manufactures the heat exchanger as an integrated mass of consolidated material using additive manufacture. The heat exchanger can be made from various materials, e.g. metals or alloys, such as titanium or stainless steel, or a polymer for example. Various forms of additive manufacturing can be used, but in one example the additive manufacture uses selective laser melting.

In summary, by providing a manifold for a heat exchanger 4 which has a first fluid manifold portion which includes a tunnel passing through a second manifold portion, this enables a more compact design with better fluid flow properties when there is a constraint on the locations of the inlet or outlet interfaces for the fluids. In one particular embodiment, by using a hollow aerofoil-shaped tunnel portion to guide the first fluid through the second manifold portion, this assists with the guiding of the second fluid as well as providing a passageway for the first fluid in order to improve the flow of the second fluid as well as providing additional heat transfer opportunity to improve the efficiency of the heat exchanger.

In the present application, the words "configured to . . . " are used to mean that an element of an apparatus has a configuration able to carry out the defined operation. In this context, a "configuration" means an arrangement or manner of interconnection of hardware or software. For example, the apparatus may have dedicated hardware which provides the defined operation, or a processor or other processing device may be programmed to perform the function. "Configured to" does not imply that the apparatus element needs to be changed in any way in order to provide the defined operation.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

The invention claimed is:

1. A heat exchanger comprising:

a heat exchanger core comprising first fluid flow channels and second fluid flow channels for exchange of heat between first fluid in the first fluid flow channels and second fluid in the second fluid flow channels;

a first manifold portion to direct the first fluid between the first fluid flow channels in the heat exchanger core and a first fluid interface portion comprising fewer first fluid flow channels than the heat exchanger core, and a second manifold portion to direct the second fluid between the second fluid flow channels and a second fluid interface portion comprising fewer second fluid flow channels than the heat exchanger core;

wherein the first manifold portion comprises at least one tunnel portion extending through the second manifold portion at an angle to the direction of second fluid flow through the second manifold portion, the first manifold portion is configured to direct at least part of the first fluid through the inside of the at least one tunnel portion and the second manifold portion is configured to direct the second fluid around the outside of the at least one tunnel portion.

2. The heat exchanger according to claim 1, wherein the first manifold portion is configured to direct the first fluid around a turn between the first fluid flow channels of the heat exchanger core and the at least one tunnel portion or between the first fluid interface portion and the at least one tunnel portion.

3. The heat exchanger according to claim 2, wherein said turn comprises a turn of at least 45 degrees.

4. The heat exchanger according to claim 1, wherein an angle between a direction of first fluid flow through said at least one tunnel portion and a direction of second fluid flow through the second manifold portion is at least 45 degrees.

5. The heat exchanger according to claim 1, wherein the first fluid interface portion is on an opposite side of the second manifold portion to an entry/exit region of the first fluid flow channels of the heat exchanger core.

6. The heat exchanger according to claim 1, wherein a leading edge of said at least one tunnel portion in the direction of second fluid flow is shaped to direct the second fluid around the outside of said at least one tunnel portion.

7. The heat exchanger according to claim 1, wherein a leading edge of said at least one tunnel portion has a round, oval, diamond or aerofoil-shaped cross-section.

8. The heat exchanger according to claim 7, wherein said at least one tunnel portion has an aerofoil-shaped cross-section and a leading edge of the aerofoil-shaped cross-section points towards one of the second fluid interface portion and the second fluid flow channels of the heat exchanger core.

9. The heat exchanger according to claim 1, wherein the first manifold portion comprises a plurality of said tunnel portions extending through the second manifold portion.

10. The heat exchanger according to claim 1, wherein the first manifold portion comprises an outer portion to direct part of the first fluid around the outside of the second manifold portion between the first fluid flow channels of the heat exchanger core and the first fluid interface portion.

11. The heat exchanger according to claim 10, comprising at least one fin bridging between an outer surface of the second manifold portion and an inner surface of said outer portion of the first manifold portion.

12. The heat exchanger according to claim 1, comprising at least one separator grid disposed inside the second manifold portion to partition the flow of second fluid flowing through the second manifold portion.

13. The heat exchanger according to claim 12, wherein at least one of said at least one separator grid is coupled to an outer surface of at least one of said at least one tunnel portion.

14. The heat exchanger according to claim 1, wherein the heat exchanger comprises an integrated mass of consolidated material.

15. A system comprising:

a combustor to generate heat by combusting a fuel; and a recuperator to recover heat from the exhaust gas output by the combustor;

wherein the recuperator comprises the heat exchanger according to claim 1.

16. The system according to claim 15, wherein the second fluid comprises the exhaust gas and the first fluid comprises air to be heated by the exhaust gas before being supplied to the combustor.

17. A method of manufacturing a heat exchanger comprising:

forming a heat exchanger core comprising first fluid flow channels and second fluid flow channels for exchange of heat between first fluid in the first fluid flow channels and second fluid in the second fluid flow channels;

forming a first manifold portion to direct the first fluid between the first fluid flow channels in the heat exchanger core and a first fluid interface portion comprising fewer first fluid flow channels than the heat exchanger core, and forming a second manifold portion to direct the second fluid between the second fluid flow channels and a second fluid interface portion comprising fewer second fluid flow channels than the heat exchanger core;

wherein the first manifold portion comprises at least one tunnel portion extending through the second manifold portion at an angle to the direction of second fluid flow through the second manifold portion, the first manifold portion is configured to direct at least part of the first fluid through the inside of the at least one tunnel portion and the second manifold portion is configured to direct the second fluid around the outside of the at least one tunnel portion.

18. The method of claim 17, wherein the heat exchanger is made by additive manufacture.

* * * * *